United States Patent [19]

Mutton

[11] Patent Number: 4,839,619

[45] Date of Patent: Jun. 13, 1989

[54] RELAY FOR WIDEBAND SIGNALS

[75] Inventor: Jon C. Mutton, Milwaukie, Oreg.

[73] Assignee: Tektronix, Inc., Beaverton, Oreg.

[21] Appl. No.: 226,338

[22] Filed: Jul. 28, 1988

[51] Int. Cl.[4] ..... H01H 50/58

[52] U.S. Cl. ..... 335/125; 335/81; 335/83

[58] Field of Search ..... 200/1 V; 335/122, 121, 335/124, 130, 133, 138, 272, 125, 78–86

[56] References Cited

U.S. PATENT DOCUMENTS

| | | | |
|---|---|---|---|
| 3,130,283 | 4/1964 | Brenneman et al. | 335/125 |
| 3,315,057 | 4/1967 | Geltner | 200/1 V |
| 4,658,230 | 4/1987 | Yamamoto | 335/81 |

*Primary Examiner*—H. Broome

*Attorney, Agent, or Firm*—Peter J. Meza

[57] ABSTRACT

A relay for wideband signals is provided having a rotor which includes a permanent magnet structure, an armature, and a microstrip pattern for selectively engaging microstrip patterns on a substrate and having a stator which includes an electromagnet. To minimize wear, while maintaining high frequency performance, the rotor is raised, rotated, and lowered by a stator or electromagnet onto the new position relative to the substrate microstrip pattern. In a first stable state the electromagnet is inactive and the rotor engages the substrate microstrip pattern in a first position. To place the relay in a second stable state, the electromagnet is energized which simultaneously attracts the armature, raising the rotor, as well as repulsing the permanent magnet structure. The rotor then rotates to the desired second position and the electromagnet is inactivated. The rotor then lowers and engages the substrate microstrip pattern in a second position.

12 Claims, 3 Drawing Sheets

RELAY FOR WIDEBAND SIGNALS

BACKGROUND OF THE INVENTION

The present invention relates to relays, and more particularly to relays capable of maintaining a characteristic impedance at microwave frequencies.

A type of relay currently used in microwave applications uses a wiper having a contact trace pattern to provide an electrical connection with a contact trace pattern on a substrate. Such a microwave relay is disclosed in a copending patent application No. 06/728,130 to Grellman, et al, entitled "Integrated Pad Switch". Specifically, FIG. 3 of Grellman discloses a substrate having a microstrip line pattern and a wiper having a contact trace pattern. Rotating the wiper causes the contact trace pattern to establish a different electrical connection with the contact trace pattern on the substrate. This type of switch has excellent high frequency characterisitcs and may be used in attenuator circuits or the like.

The problem with such prior art relay structures lies in the wiper which slides across the substrate as the various electrical connections are formed. In order to have a long operational life and low operating forces, the surfaces of the wiper and the substrate must be very smooth, hard and have low friction. Most common substrates found in hybrid circuits are ceramic and hard, but not smooth, and therefore have relatively high coefficients of friction. A fundamental tradeoff exists between low resistance electrical connections and long operational life. That is, a low resistance electrical connection requires large normal forces to minimize contact resistance which leads to excessive wear and short operational life, whereas long operational life mandates small normal forces which produces a poor electrical connection.

Therefore, what is desired is a microwave relay which has excellent frequency characteristics, yet achieves this performance without excessive wear between the wiper and the substrate, leading to long operational life.

SUMMARY OF THE INVENTION

In accordance with the present invention, a relay for wideband signals is provided having a rotor which includes a microstrip pattern for selectively engaging microstrip patterns on a substrate. To minimize wear, while maintaining high frequency performance, the rotor is raised, rotated, and lowered onto the new position relative to the substrate microstrip pattern.

In a preferred embodiment, the substrate includes a ground plane and a set or pattern of traces which form microstrip transmission lines of a desired characteristic impedance. The pattern of traces includes a main trace having a gap, and first and second pairs of contact traces. Coupled to the substrate is a C-shaped stator or electromagnet including two pole pieces, a core pin, and a coil. Within the gap of the stator is a rotor which includes a pattern of contact traces on a dielectric for engaging the pattern of traces on the substrate. The rotor also includes a cruciform permanent magnet structure coupled to an armature. These two elements are separated from the dielectric by an elastomer layer.

In a first stable state the electromagnet is inactive and the rotor engages the substrate microstrip pattern in a first position, routing the main trace to the first pair of contact traces. To place the relay in a second stable state, the electromagnet is energized which simultaneously attracts the armature as well as repulsing two arms of the permanent magnet structure, thus raising the rotor. The repulsion, in conjunction with an attraction of the remaining two arms causes the rotor to rotate to the desired second position and the electromagnet is inactivated. The rotor then lowers and engages the substrate microstrip pattern, routing the main trace to the second pair of contact traces.

It is therefore an object of the present invention to provide a relay which sustains long operational life while maintaining microwave frequency performance.

DETAILED DESCRIPTION

Figure 1:
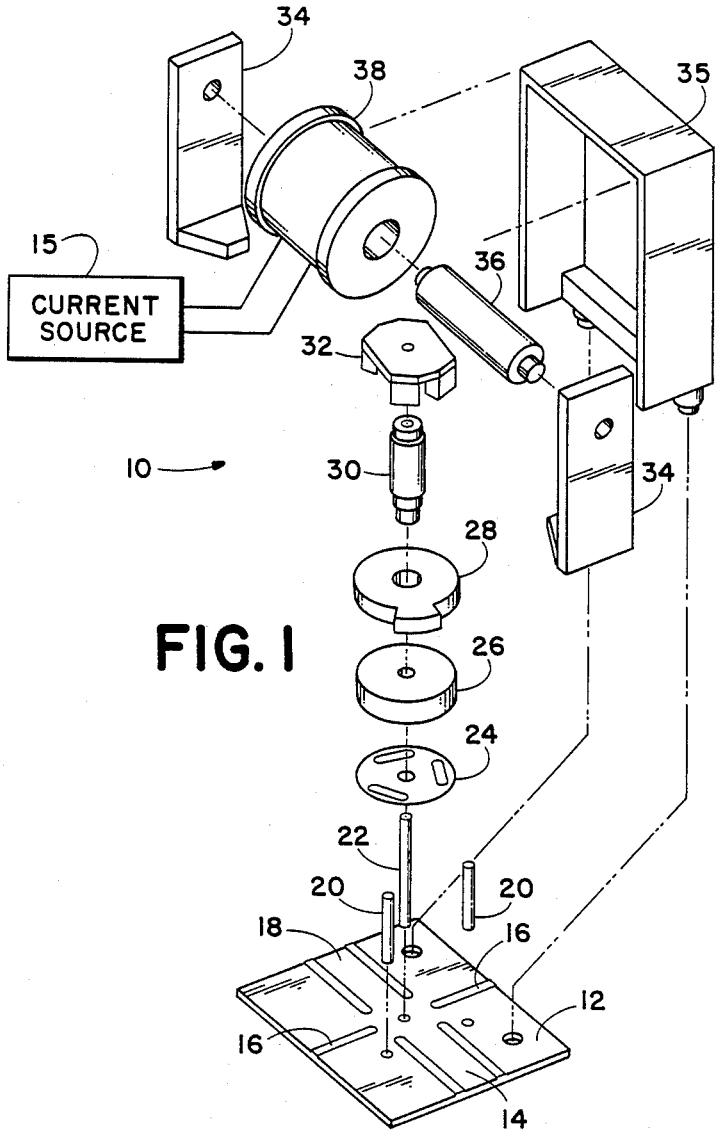
FIG. 1 is an exploded view of the relay according to the present invention.

The wideband relay 10 according to the present invention is shown in FIG. 1. A substrate 12 is depicted which may be a conventional hybrid substrate, a circuit board, or any mounting surface for microstrip traces. A main trace 16 is desired to be routed to a first pair of traces 14 or a second pair of traces 18. The first pair of traces 14 or second pair of traces 18 may be terminated in a short circuit or an attenuator circuit, or any circuit which is desired to be placed in series with the main trace 16.

A stator is also shown in FIG. 1 which includes a housing 35, two poles pieces 34, a coil 38 and a core pin 36. The coil is wrapped around core pin 36, and together with the magnetic pole pieces forms an electromagnet. When the stator is assembled and energized, a north and south magnetic pole form at the ends of pole pieces 34 which are not attached to the core pin 36. The same ends of pole pieces 34 form a pole gap into which the rotor is inserted. Stop pins 20 are attached to the substrate 12 to prevent further rotation of the rotor which will be described below.

The housing 35 serves to locate and rigidly mount the entire substrate assembly to the substrate. This, in turn, ensures that the pole gap is symmetrically aligned with the axle. The housing 35 may be constructed such that it includes a ledge or step to limit rotation and thus serve the same function as the stop pins 20.

A rotor is also shown in FIG. 1 which includes a cruciform permanent magnet structure 32, a spacer 30, a magnetic armature 28, an elastomer layer 26, and a flexible dielectric layer 24, which contains a contact trace pattern (shown through the flexible dielectric layer 24) for engaging the contact trace pattern on the substrate. Upon assembly, each of these elements is joined together, and the entire rotor assembly is rotatably mounted to an axle 22, the axle being mounted to the substrate 12. The cruciform permanent magnet structure includes four "arms", each of which is a permanent magnet, arranged axially. The magnets are arranged in diagonally opposite pairs, and the angle between each of the pairs is less than 90 degrees. Each magnet in the pair is arranged axially, but with opposite north and south poles. Opposing magnets are also arranged axially, with opposite north and south poles.

Attached to the permanent magnet structure 32 is a spacer 30 which maintains the proper level of the permanent magnet structure 32 relative to the pole pieces 34. A magnetic armature 28 is attached to the spacer 30. Both the permanent magnetic structure 32 and the magnetic armature 28 interact with the stator to produce the raising, rotating, and lowering of the rotor, which will be described below. An elastomer layer 26 is interposed between the magnetic armature 28 and a flexible dielectric 24 containing a pattern of contact traces for engaging the contact traces on the substrate 12. The purpose of the elastomer layer 26 is to provide a low dielectric constant mechanical connection while compensating for any slight imperfections or lack of alignment in the assembly.

The switching of the relay is controlled by magnetic forces generated by the stator which operate on the rotor. In a first stable state, the stator is inactivated and the contact trace pattern on the dielectric layer 24 is in electrical connection with the contact trace pattern on the substrate 12 such that the main trace 16 is rotated through the first pair of contact traces 14. In this first position, the spacer 30 is designed to place the cruciform permanent magnet structure 32 just above the ends of the pole pieces 34. The cruciform permanent magnet structure 32 is strongly attracted to the pole pieces 34, which pulls the entire rotor assembly down, compressing the elastomer layer 26 and bringing the contact traces of the dielectric layer 24 and the contact traces of the substrate 12 into electrical connection. Energizing the stator with a current (provided by current source 15) flowing in the appropriate direction causes a repulsive force between the permanent magnetic structure 32 and the pole pieces 34 and, simultaneously, an attractive force between the pole pieces 34 and the magnetic armature 28. The interaction of these two forces causes the rotor to rise, breaking the electrical connection between the contact traces on the substrate 12 and the contact traces on the dielectric layer 24. The magnetic force exerted by the pole pieces 34 and the acute angle between magnet pairs in the permanent magnet structure 32 cause the rotor to simultaneously rotate. The rotor rotates until the permanent magnet structure 32 has become aligned with the next magnet in the pair. However, such rotation is permaturely terminated by stop pins 20. This termination assures precise alignment. As long as the stator is energized, a downward force exists between the permanent magnet structure 32 and the pole pieces 34 and an upward force exists between the pole pieces 34 and magnetic armature 28. The dimensions of the relay, particularly the length of the spacer 30, are such that the upward force exceeds the downward force in order that the rotor stays elevated as long as current is maintained in the coil. When the current is removed, the rotor, now in a second position, is again pulled down by the attractive force of the permanent magnet structure 32 to the pole pieces 34. In this second stable state, the elastomer layer 26 is once again compressed, and the contact traces of the dielectric layer 24 and the substrate 12 are in electrical connection, but in a different orientation.

Figure 2:
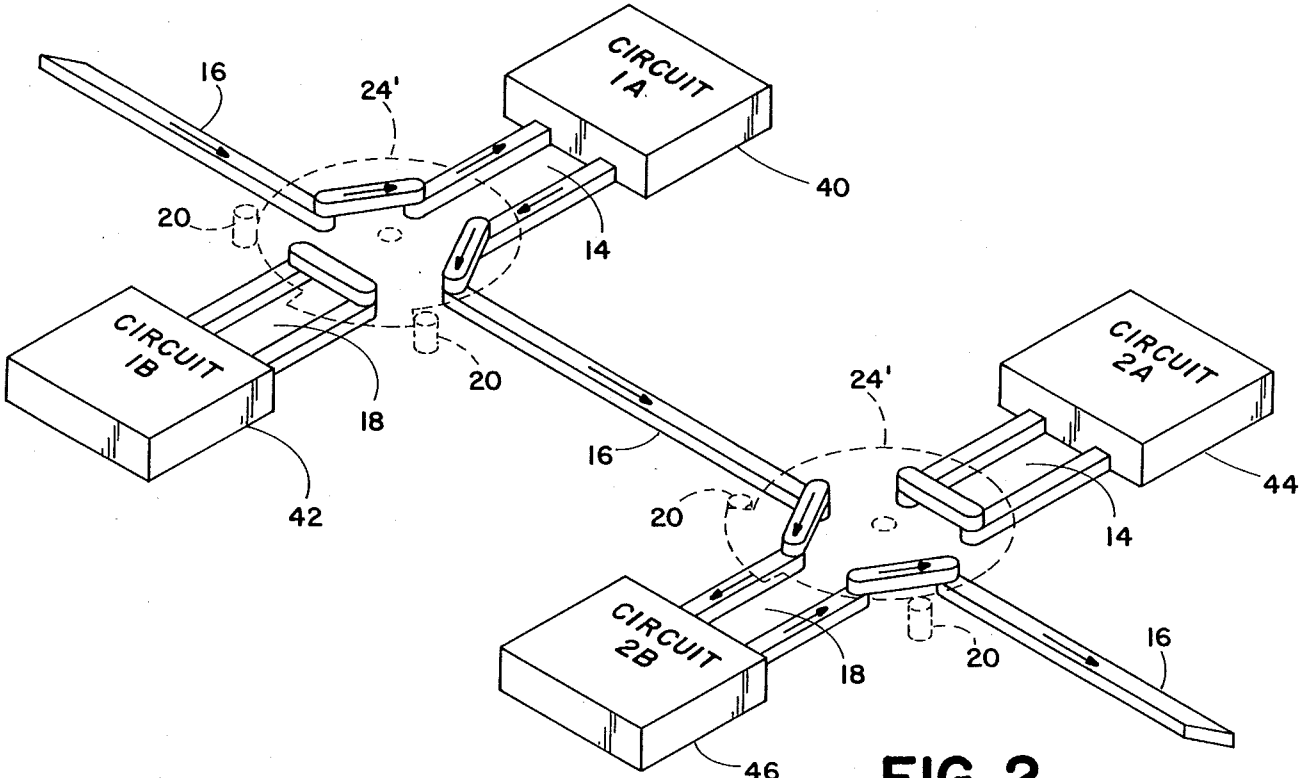
FIG. 2 is a schematic diagram showing the rotor trace pattern engaging the substrate trace pattern in two stable states.

The electrical connection in each of the stable states (no current flow in the coil) is shown in FIG. 2. The main trace 16, first pair of contact traces 14, a second pair of contact traces 18 and stop pins 20 are shown as in FIG. 1. However, only the outline of the rotor is shown which reveals the contact trace pattern 24'. Note that this contact pattern is comprised of three separate traces, each at an angle of 60 degrees from the other two. This angle need not be limited to 60 degrees, especially if it is undesirable to short out the circuit which is not coupled to the main trace. A better understanding of the switching action of the rotor may be obtained from studying the trace patterns of FIG. 2. In the first stable state the trace pattern 24' of the rotor makes an electrical connection with the first pair of contact traces 14 which in turn connects circuit 40 in series relation with the main trace 16. Circuit 42 is disconnected from main trace 16, and the second pair of contact traces 18 is shorted by the dielectric trace pattern 24'. Notice that the rotation of the rotor trace pattern 24' has been limited by stop pins 20. Similarly, FIG. 2 also shows a relay in the second stable state. The trace pattern 24' is shown to make an electrical connection with the second pair of contact traces 18 which in turn connects circuit 46 in series relation with the main trace 16. Circuit 44 is now disconnected from main trace 16, and the second pair of contact traces 14 is shorted by the dielectric trace pattern 24'. Notice that the rotation of the rotor trace pattern 24' has been limited by stop pins 20, but in the opposite direction.

Figure 3:
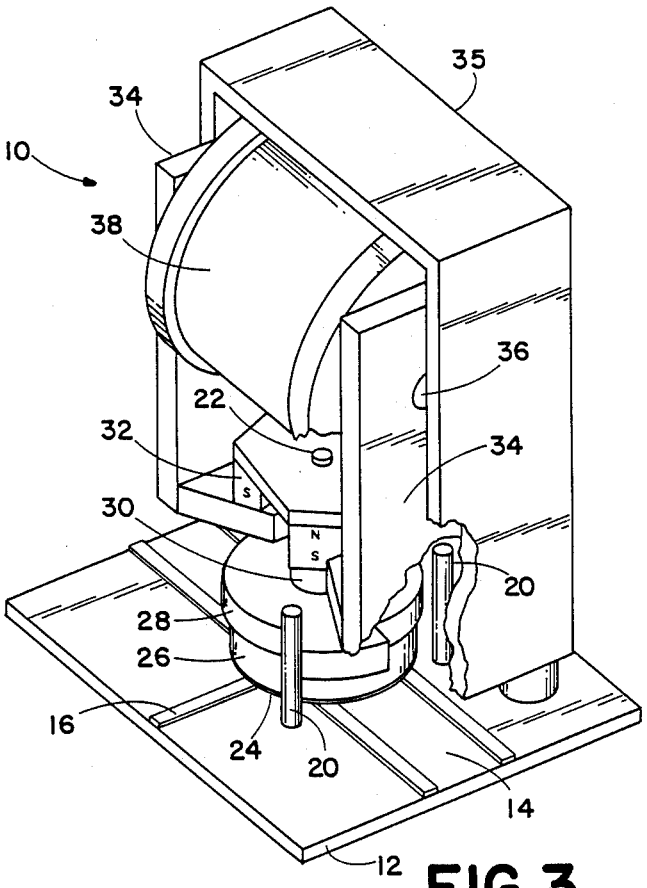
FIG. 3 is a cutaway view of the assembled relay according to the present invention.

The assembled wideband relay 10 is shown in FIG. 3. The proper relation of the rotor and stator are clearly shown. The cruciform permanent magnet structure 32 is shown above the pole pieces 34, with the housing 35 and one pole piece 34 being cut away to reveal the space necessary for proper operation. The magnetic armature 28 and dielectric 24 are shown below the pole pieces 34 and separated by the spacer 30.

To achieve maximum performance it may be desired to alter the basic wideband relay structure slightly. To compensate for the effective dielectric constant of the elastomer layer, it may be desirable to narrow the contact traces on the dielectric 24, and the contact traces on the substrate which are underneath the dielectric 24. To achieve a small amount of contact wipe, it may be desirable to tilt the stop pins 20 slightly. This will cause the rotor to turn as it moves into either of the closed contact positions. Finally, in order to reduce contact resistance and improve contact reliability, it may be desirable to bond a short piece of small diameter contact wire perpendicularly and at the edge of the stator and rotor contacts to form a cross-bar contact structure.

Having described and illustrated the principles of my invention with reference to a preferred embodiment and variations thereof, it should be apparent to those skilled in the art that the invention may be modified in arrangement and detail without departing from those principles. I claim all modifications that are within the scope and spirit of the following claims.

I claim:

1. A relay for wideband signals comprising:
   a. a stator attached to a mounting surface, the mounting surface having a first pattern of contact traces;
   b. a rotor including a magnetic armature attached to a cruciform permanent magnet structure rotatably attached to the mounting surface, said rotor containing a second pattern of contact traces, such that the first pattern of contact traces is coupled to the second pattern of contact traces in a first stable state; and
   c. means for momentarily energizing said stator to raise, rotate, and lower said rotor such that the first pattern of contact traces is coupled to the second pattern of contact traces in a second stable state.

2. A relay for wideband signals as in claim 1 wherein the stator comprises:

a. a pair of pole pieces;

b. a core pin attached at each end to one of said pair of pole pieces; and c. a coil surrounding said core pin.

3. A relay for wideband signals as in claim 1 wherein the rotor further comprises a dielectric containing the second pattern of contact traces, said dielectric being attached to said magnetic armature.

4. A relay for wideband signals as in claim 3 wherein the cruciform permanent magnet structure comprises a first pair of permanent magnets whose magnetic poles are arranged axially, and a second pair of permanent magnets whose magnetic poles are arranged axially, but of opposite polarity.

5. A relay for wideband signals as in claim 3 further comprising an elastomer interposed between said magnetic armature and said dielectric.

6. A relay for wideband signals as in claim 3 wherein the mounting surface includes a pair of stop pins.

7. A relay as in claim 6 wherein the magnetic armature further comprises a projection for engaging the stop pins.

8. A relay for wideband signals as in claim 1 wherein the first pattern of contact traces comprises:

a. a main trace having a gap;

b. a first pair of contact traces proximate to the gap; and c. a second pair of contact traces proximate to the gap.

9. A relay for wideband signals as in claim 8 wherein the second pattern of contact traces comprises three separate contact traces placed at predetermined angles in relation to each other, such that the main trace is coupled to the first pair of contact traces in the first stable state and the main trace is coupled to the second pair of contact traces in the second stable state.

10. A relay for wideband signals as in claim 1 wherein the second pattern of contact traces comprises three separate contact traces placed at predetermined angles in relation to each other.

11. A relay for wideband signals comprising:

a. a stator having an electromagnet, said stator being attached to a mounting surface, the mounting surface having a main contact trace having a gap, and first and second pairs of contact traces proximate to the gap; and b. a rotor which is rotatable about a central axle, the axle being attached to the mounting surface, having a cruciform permanent magnet structure having a first pair of permanent magnets whose magnetic poles are arranged axially and a second pair of permanent magnets whose magnetic poles are arranged axially, but of opposite polarity, a magnetic armature attached to the cruciform permanent magnet structure, and a dielectric attached to the armature containing a predetermined contact trace pattern, c. means for momentarily energizing the electromagnet to raise, rotate, and lower said rotor such that the main contact trace is coupled to the first pair of contact traces in a first stable state, and the main contact trace is coupled to the second pair of contact traces in a second stable state.

12. A relay for wideband signals as in claim 11 wherein the rotor further comprises an elastomer interposed between the magnetic armature and the dielectric.

* * * * *